United States Patent [19]

Sahley

[11] 4,277,106

[45] Jul. 7, 1981

[54] SELF RENEWING WORKING TIP MINING PICK

[75] Inventor: Lloyd W. Sahley, Mayfield Heights, Ohio

[73] Assignee: Syndrill Carbide Diamond Company, Cleveland, Ohio

[21] Appl. No.: 86,648

[22] Filed: Oct. 22, 1979

[51] Int. Cl.[3] ..... E21C 25/38

[52] U.S. Cl. ..... 299/79; 125/43; 299/94; 407/118

[58] Field of Search ..... 175/374, 375, 410, 409; 299/86, 94, 79; 76/108 R, 108 A, DIG. 11; 407/118, 119; 125/143

[56] References Cited

U.S. PATENT DOCUMENTS

| | | | |
|---|---|---|---|
| 1,859,350 | 5/1939 | Wilson | 407/118 |
| 1,965,950 | 7/1934 | Walker | 407/118 |
| 3,984,910 | 10/1976 | Helton | 175/374 |

FOREIGN PATENT DOCUMENTS

| | | | |
|---|---|---|---|
| 2004315 | 3/1979 | United Kingdom | 299/86 |

*Primary Examiner*—William F. Pate, III
*Attorney, Agent, or Firm*—Yount & Tarolli

[57] ABSTRACT

A self renewing working tip tool characterized by a plurality of working tip surfaces on individual laminae assembled in nested relation. The laminae are of hardened steel and each has a hard metal carbide coating thereon. A series of such laminae are bonded together and secured to a suitable tool shank to form a tool useful in breaking concrete, mining coal, and the like, where a hard working surface is required. These tools have an extended working life compared to conventional embodiments.

9 Claims, 3 Drawing Figures

SELF RENEWING WORKING TIP MINING PICK

BACKGROUND AND PRIOR ART

This invention relates to tools, particularly those used in working against hard materials of natural or synthetic origin, e.g., coal, minerals, or concrete pavement, or the like. Such tools are frequently provided with a hard metal carbide tip or insert to better withstand the harsh working surface and provide longer life before replacement becomes necessary. These tools are mounted so as to be freely rotatable in the sockets provided therefor. A typical example of tools of the type to which this invention relates is shown in U.S. Pat. No. Reissue 29,900.

Tungsten carbide working tip inserts have long been known. Sintered tungsten carbide compacted bodies have been found highly useful for cutting, drilling and other tools as well as the production of solid carbide wear parts which are required to be highly resistant to wear as by abrasion and the like, e.g., percussion tools such as coal mining picks, etc.

The volume of mining picks used in this country on an annual basis runs into the tens of millions. A large portion of these picks is provided with a hardened steel shank and a working tip comprising a sintered tungsten carbide insert brazed into a suitable socket at the working end of the tool of the type shown in FIG. 3 of the drawings and identified as "prior art". Under the best operating conditions, the tungsten carbide inserts have a limited life and are subject to rounding off, undercutting wear of the steel body resulting in dislodgment from the socket whereupon the tool wears very rapidly and must be replaced. As a consequence, mining machinery or other machinery utilizing picks is shut-down pending replacement of the picks on the cutter heads.

It is an object of this invention, therefore, to provide an improved working tool especially suited for use as a coal or mineral mining pick, which minimizes the problem of point round off and is capable of operation over a longer period of time than conventional picks before replacement is required.

These and other objects and advantages of the invention which will appear as the description of proceeds, or become evident to those familiar with this art, may be achieved by providing a tool with a self-renewing working tip. As the working tip is worn away by abrasion, impact, loading, corrosion and the like, a renewed working tip is automatically presented as use of the tool is continued.

BRIEF STATEMENT OF THE INVENTION

Briefly stated, the present invention is in an improved mining tool, embodiments of which are especially adapted for use in mining machinery or in breaking concrete pavement, and characterized by a self-renewal working portion and a shank portion. The working portion is composed of a plurality of conical cup-shaped laminations or cone members, anchored or adhered together and attached to the distal end of the shank portion. The laminations are each formed so that the outside conical face thereof, i.e., the obverse side, provides a working tip face and each lamination is desirably formed of a hardened steel body having a harder portion providing the obverse face of the lamination. The harder portion may be a harder part of the cup-shaped lamination such as is produced by carburizing or by differently temporizing the outside portion of the lamination or preferably it may be an applied metal carbide coating. The coating or depth of the hardened surface portion may range from 0.0001" to 0.063", for example, but is preferably in the range of 0.002" to 0.035" thick. In certain embodiments of this invention, a sintered tungsten carbide core extends through each of the laminae and projects from the distal end of the tool to provide a carbide tip. As the metal carbide coating or surface portion is worn away a hard steel working face in the range of Rockwell C 52 to Rockwell C 65 is exposed which, while providing some working life, will more quickly wear to expose a new hard metal carbide working face. This occurs several times during the life of the tool. Working life is extended and down time of the machinery for pick replacement is reduced. Also, the relatively thin coatings utilize the matrix metal much more favorably so that in the long run, costs for this component are reduced.

Alternatively, the built-up working tip may be formed of alternating nested layers of hardened steel and sintered tungsten carbide, each shaped to the desired working face configuration.

BRIEF DESCRIPTION OF THE DRAWINGS

Further features of the present invention will be apparent to those skilled in the art to which this invention relates from the following detailed description of preferred embodiments thereof made with reference to the accompanying drawings in which.

DETAILED DESCRIPTION OF THE PREFERRED EMBODIMENTS

Figures 1, 2, 3:
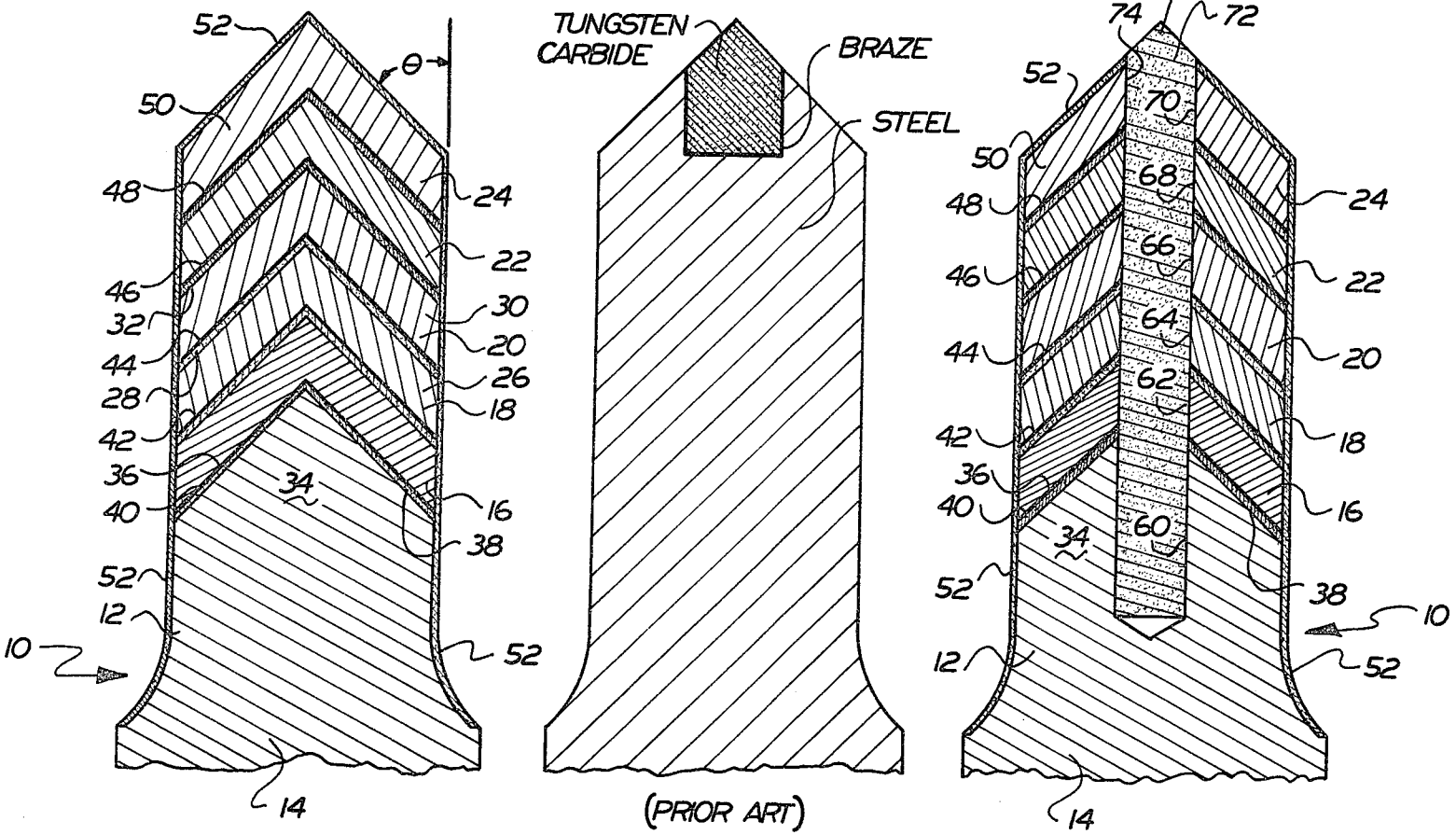
FIG. 1 is an axial cross-sectional view of a portion of a self-renewing mining pick in accordance with this invention.
FIG. 2 is an axial cross-sectional view of another embodiment of a self-renewing mining pick in accordance with this invention.
FIG. 3 is an axial cross-sectional view of a typical prior art mining machine pick.

Referring now more particularly to FIG. 1, there is here shown in axial cross section the working end of a mining machine pick and a small portion of the shank end. The shank end is conventional for freely rotating tools in mining machines. Such mining machine picks are well known and the general outlines of the entire tool is well known. FIG. 1 shows a portion of a mining pick 10 having a working end 12 and a shank portion 14, partially shown in FIG. 1. The shank portion 14 may be configured in any manner suitable for use in a given mining machine. The working end or distal end 12 of the tool 10 is provided by a nose comprising a series of nested conical, cup-shaped laminations, or cone members, 16, 18, 20, 22 and 24 which form a laminated nose having a conical tip or working surface formed by the top lamination with the innerlaminations presenting new tips as the pick wears. While five such nose cone laminations are shown in FIG. 1, fewer or more may be used.

Each cone member 16, 18, 20, 22 is formed of a hardened steel body 26 which has a hardened surface portion or a coating bounded thereto for providing the obverse working face of the lamination, the metal internally of the coating or hardened surface portion wearing at a relatively fast rate as compared to the coating or harder portion of the lamination so that when the coating or harder portion is worn through the lamination wears relatively fast to quickly expose the harder portion or the coating of the conical tip of the next conical lamination. Preferably, each of the laminations has a coating of a metal carbide applied to the steel body 26. The steel body or shank portion 12 is provided with a conical tip portion 34 geometrically configured to nest into the adjacent nose cone member 16 as shown in FIG. 1. The outer surface of the body tip portion 34 is also provided with a thin coating 38 of a metal carbide or a carburized metal surface.

The nose cone laminations are bonded to each other and to the tip portion 34 as by brazing or other suitable bonding methods. In the preferred and illustrated embodiment, the laminations are brazed together. Referring to FIG. 1, layers of brazing material, 40, 42, 44, 46 and 48 for respectively bonding the cone member 16 to the tip portion 34, the cone lamination 18 to the cone lamination 16, etc, are provided.

In fabricating the tools of the present invention, the tool body may be machined from bar stack, forged, or cast. To toughen the tool, it is desirably hardened to a Rockwell C hardness in the range from about 43–48. The cones 16, 18, 20, 22 and 24 are conveniently produced on an automatic screw machine from bar stock or cold drawn steel. These are heat treated to a hardness in the range of from Rockwell C 52–65. If brazing, this is done during the brazing operation to prevent softening of the cone members as would occur if the heat treating were done prior to brazing. For example, brazing rings or cups of brazing solder are conveniently assembled with the nose cone members prior to fusion of the silver solder or other brazing materials. The nose cones and brazing rings are then assembled onto the tool portion 12, and the assembly introduced into a furnace or induction heating machine to raise the temperature of the steel to its hardening temperature which also brazes the parts together. Finally, the assembled tool is quenched to harden the steel to a Rockwell C hardness of from 43–48 or from 52–65 Rockwell C as may be desired. After heating, a spray or dip quench in oil is done at the proper temperature to set the desired hardness of the steel.

While top cone member 24 is preferably provided with a steel body 50 in the same way as the previous nose cone members 16, 18, 20 and 22, the top cone member 24 may be coated prior to brazing onto nose cone member 22, or brazed into place with the intermediate bonding layer 48 without prior coating, and subsequently coated in place. The entire working end 12 of the tool 10 is preferably coated to provide an external coating 52 of metal carbide which desirably extends to the point where the shank portion 14 is necked down to form the working end 12.

The conical angle of the nose cone laminations is preferably empirically determined by using a test pick of the conventional type of relatively soft material in the machine in which the pick is to be used. The test pick will quickly wear to the proper conical angle for the machine. This will be the proper angle to incorporate in the pick of the present invention. In general, the angle "$\theta$" as indicated in FIG. 1 is from 30° to 60°. Wear is evenly distributed on the nose portion because of the ability of the tool to rotate in its socket.

FIG. 2 is a modification of the tool structure shown in FIG. 1. In this embodiment, the tool is bored axially to provide a bore 60. The cone members 16, 18, 20, 22 and 24 are bored, preferably prior to coating to provide coaxial openings 62, 64, 66 68 and 70. The bore 60 and the individual bores 62, 64, 66, 68 and 70 in the nose cone members 16, 18, 20, 22 and 24 provide a blind bore for the receipt and retention of a sintered tungsten carbide rod 72. The rod 72 has a projecting tip portion **72*a* which, with the top cone lamination 50**, provides the conical work tip of the pick.

In the case of the tungsten carbide rod structure of FIG. 2, the rod is properly sized and then ground to the desired nose angle which again is preferably determined to be the natural wear angle of the nose as generated by the machine holding a test pick and working against the surface as ultimately intended. The tungsten carbide rod is inside a sleeve of brazing material 74 which bonds the rod into the tool body and into the nose cone members when the pick nose is heated to bond the cone members to each other and to the shank tip.

The hard coatings applied to the laminations to provide the working face do not in and of itself form a part of the present invention. Hard commercial coatings are available and conventional as well as techniques of applying them. In a coating sense, it should be pointed out that sintered tungsten carbide in a steel alloy is considered to be a hard coating within the context of the invention. As described above, the characteristic feature of applicant's invention involves a lamination for the nose of the pick which in and of itself has a hard portion providing the working face or a tip for the pick with a softer portion internally of the hard portion so that the support for the harder portion will wear quickly once the harder portion wears through to expose a new tip surface. The particular coating or method of providing the harder portion for constituting a working face of the lamination will depend upon the cost of providing the coating as compared to the increased life. For example, various hard coatings may not justify their use in view of their cost relative to other coatings.

In the embodiment of FIG. 2, it will be recognized that the protruding tip portion of the sintered tungsten carbide rod 72, will renew itself because of the small diameter the rod utilizes. When sintered tungsten carbide is used in a rod of small diameter, it will tend to break down and easily wear to a point when utilized as the tip of a cone shaped lamination. A typical rod diameter is 3/16" or less.

What is claimed is:

1. A pick having a shank and a nose portion extending from the shank and terminating in a conically-shaped lead end working face for the pick, said nose portion having an axis coinciding with the pick axis, said pick being adapted to be mounted for rotation about said pick axis by a tool holder of a machine for utilizing the pick, said nose portion comprising a series of alternating conically-shaped laminations of hard and softer materials overlying each other proceeding axially of said pick axis, with the layer at the lead end of the pick forming the working face of the pick, said laminations each being concentric about the pick axis and diverging away from the pick axis and the lead end of the pick whereby in use the laminations successively present conically-shaped lead end working faces with the laminations of softer material wearing quickly to expose the next lamination of hard material.

2. A pick as defined in claim 1 wherein said softer material is steel.

3. A pick as defined in claims 1 or 2 wherein said hard material is one of a metal carbide or hard steel.

4. A pick as defined in claim 1 wherein said nose portion has an axial bore therein and a tipped carbide insert rod therein extending through said laminations.

5. A pick having a nose portion providing a conical tip for leading the pick and a shank, said pick being adapted to be mounted for rotation in a tool holder of a machine for utilizing the pick, said nose portion comprising alternate conical layers, proceeding from the lead end of the pick and diverging from the axis of the conical layers in a direction away from the lead end, of hard material for forming a hard pick working face and a layer of softer support material of lesser hardness whereby in use the less hard material will quickly wear to expose the adjacent layer of hard material to renew the conically shaped point of the pick, said nose portion being formed of conical shaped laminations each having an outside cup-shaped portion formed by one of said layers of hard material and an internal cup-shaped portion formed by one of said layers of softer material and supporting said outside cup-shaped portion whereby the outside portion is adapted to function as a hard working face for a pick.

6. A pick as defined in claim 5 wherein said laminations are bonded together by soldering.

7. A pick as defined in claim 5 wherein said laminations have an internal portion of steel and an outside portion formed by a coating harder than the steel.

8. A pick as defined in claims 5 or 6 wherein said outside portions of said laminations are metal coatings on said internal portions.

9. A pick as defined in claim 8 wherein said internal portions of said laminations are steel.

* * * * *